US005474426A

United States Patent [19]

Wang

[11] Patent Number: 5,474,426

[45] Date of Patent: Dec. 12, 1995

[54] ROTATING DEVICE FOR AN ILLUSION-RAISING PROTECTIVE NET OF AN ELECTRIC FAN

[76] Inventor: Tsai-Sou Wang, No. 26-10 Chung Chou, Hsi Kang Tsun, Hsi Kang Hsiang, 72301 Tainan Hsien, Taiwan

[21] Appl. No.: 271,591

[22] Filed: Jul. 6, 1994

[51] Int. Cl.[6] ..... F04D 29/70

[52] U.S. Cl. ..... 416/247 R; 415/125

[58] Field of Search ..... 416/247 R, 170 R; 415/125

[56] References Cited

U.S. PATENT DOCUMENTS

| | | | |
|---|---|---|---|
| 2,336,295 | 12/1943 | Reimuller | 415/125 |
| 3,262,638 | 7/1966 | Militello | 416/247 R |
| 4,743,737 | 5/1988 | Tateishi | 415/125 |
| 5,368,453 | 11/1994 | Peng | 416/247 R |

FOREIGN PATENT DOCUMENTS

| | | | |
|---|---|---|---|
| 0451597 | 8/1936 | United Kingdom | 415/125 |
| 0927134 | 5/1963 | United Kingdom | 415/125 |

*Primary Examiner*—Edward K. Look
*Assistant Examiner*—Mark Sgantzos
*Attorney, Agent, or Firm*—Pro-techtor International

[57] ABSTRACT

A rotatable device for a protective net of an electric fan including a vertical base, a synchronous motor fixed on a rear surface of the base, a gear fixed on the shaft of the motor, a first sleeve supported on the shaft of the motor of an electric fan and fitting through a center hole of the base to fit around a rear small diameter shaft hole of a rotatable sleeve and then to engage a rotatable sleeve locking nut fitted in a front large diameter shaft hole of the rotatable sleeve, a net locking nut engaging a male threaded portion of the rotatable sleeve to secure the net ring of the protective net of an electric fan with the rotatable sleeve having a gear portion to engage the gear so that the protective net may be rotated by the rotatable sleeve.

4 Claims, 7 Drawing Sheets

ROTATING DEVICE FOR AN ILLUSION-RAISING PROTECTIVE NET OF AN ELECTRIC FAN

BACKGROUND OF THE INVENTION

This invention concerns a rotating device for a protective net of an electric fan, enabling the protective net to rotate to force the wind produced by the fan to swirl and increase the wind volume and give rise to illusory appearances to the human eye by its rotation.

Conventional electric fans generally have their fans fixed at a given position. It is impossible to force the wind produced by the fan to be blown in different directions unless the head of the fan is made to swing to the right and to the left.

SUMMARY OF THE INVENTION

An object of the present invention is to offer a kind of rotating device for a protective net of an electric fan. The device rotates the protective net simultaneously with the fan rotating so as to produce a cutting movement of the net against the wind produces by the fan so that the wind may be made to swirl on every direction.

A rotating device for a protective net of an electric fan of the present invention comprises a vertical base shaped like a shallow case with an open front side. The base contains a first gear, a rotatable sleeve, a sleeve locking socket, and a synchronous motor for driving the protective net via the first gear engaging with a second gear. A portion of the rotatable sleeve receives a net ring of the protective net so that the net may be rotated by the rotatable sleeve via the gears driven by the synchronous motor. A first sleeve is also provided in the deice, having a center shaft hole to receive the shaft of the motor. The net ring is secured between an intermediate flange of the rotatable sleeve and a net locking nut engaging a threaded tubular portion of the rotatable sleeve.

DETAILED DESCRIPTION OF THE INVENTION

Figure 1:
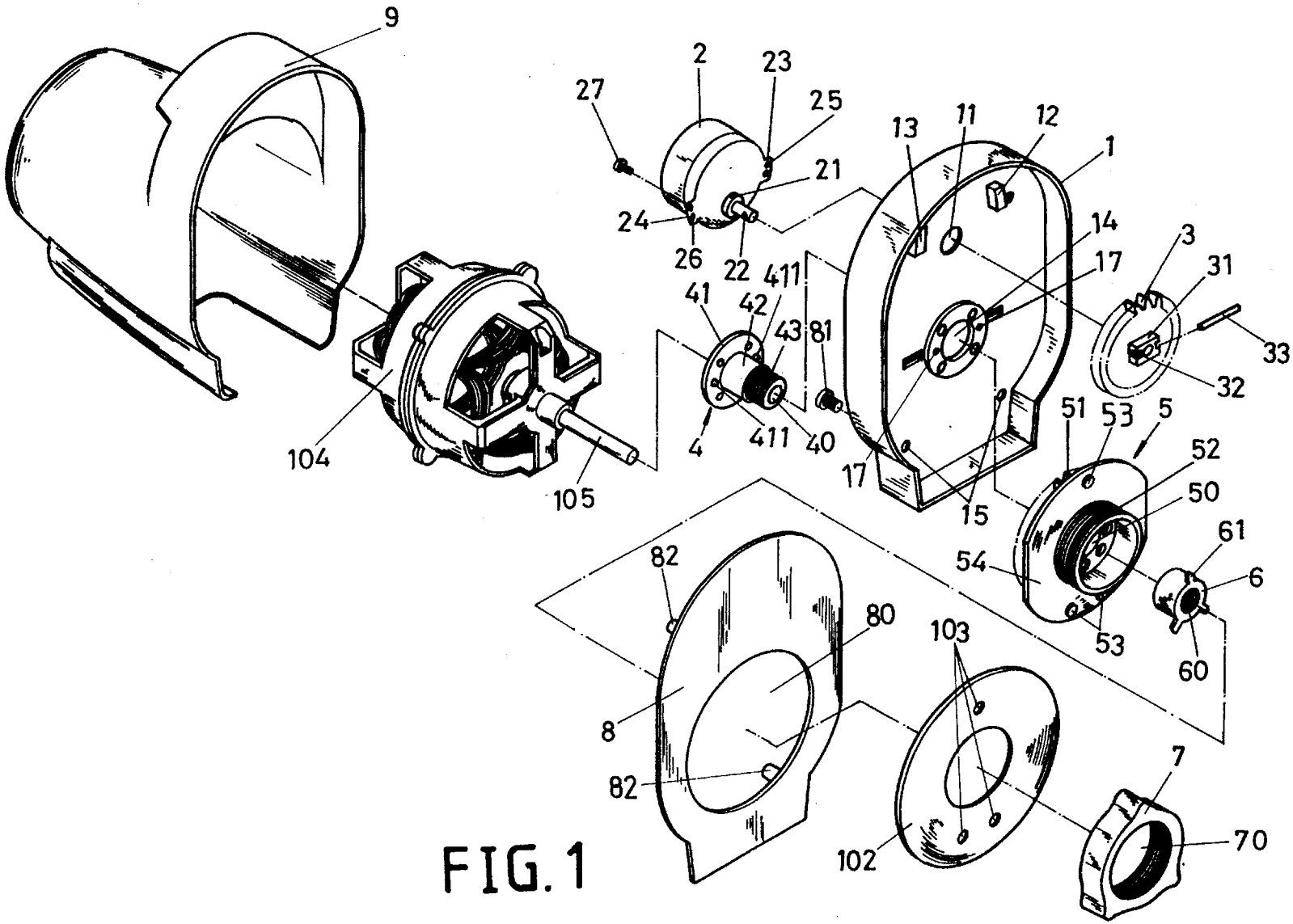
FIG. 1 is an exploded perspective view of a rotating device for a protective net of an electric fan of the present invention.

A rotating device for a protective net of an electric fan of the present invention, as shown in FIG. 1, comprises a base 1, a synchronous motor 2, a gear 3, a first sleeve 4, a rotatable sleeve 5, a rotatable sleeve locking nut 6, a net ring locking nut 7, a front cap 8 and a housing 9 as its main components.

The base 1 is a shallow, vertically oriented case with an open front side. The base 1 includes a shaft hole 11 in an upper portion of a rear wall. A shaft 21 of a synchronous motor 2 to passes through the shaft hole 11. There are two projections 12, 13 on an inner surface of the rear wall located a little above and at each side of the shaft hole 11. The rear wall also includes a center hole 14 and two small holes 17, 17 on opposite sites of the center hole 14, and two pairs of post holes 15 respectively spaced apart in an upper and a lower portion of the rear wall. There is a circumferential groove 16 on a rear circumferential edge of the rear wall to receive a front circumferential wall edge of the housing 9.

The synchronous motor 2 has two opposing ears 23, 24 each bored with two screw holes 25, 26 for screws 27 to pass through to engage the two projections 12, 13 of the base 2 to mount the motor 2 on the rear surface of the rear wall of the base 1. A shaft 21 passes through the shaft hole 11 and protrudes through the front open side of the base 1. The shaft 21 has a lateral pin hole 22 that aligns with a pin hole 32 of the gear 3 f or a pin 33 to fit therein to affix the gear 3 to the shaft 21.

Figure 2:
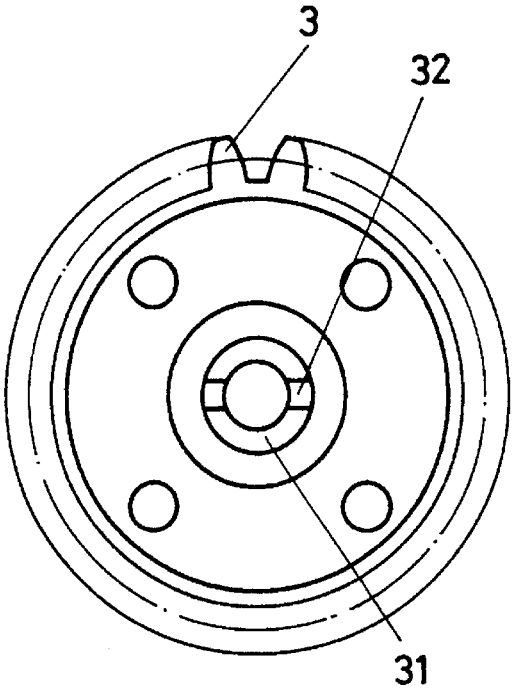
FIG. 2 is a rear view of a gear in the rotating device for a protective net of an electric fan of the present invention.
Figure 3:
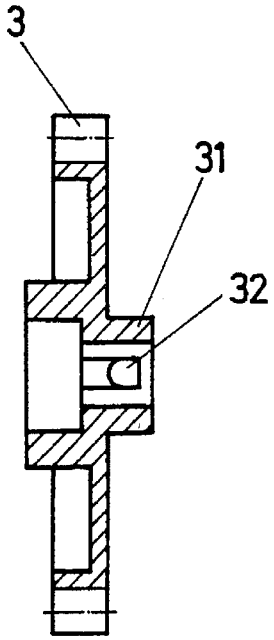
FIG. 3 is a cross-sectional view of the gear in the rotating device.

The gear 3 as shown in FIGS. 2 and 3 has a projection 31 in the center that includes the lateral pin hole 32. The pin 33 fits through the pin hole 32 and also through the pin hole 22 of the shaft 21 of the synchronous motor 2 to fix the gear 3 to the shaft 21 of the motor 2. The gear 3 engages a gear portion 51 of the rotatable sleeve 5 to rotate the rotatable sleeve 5.

Figure 4:
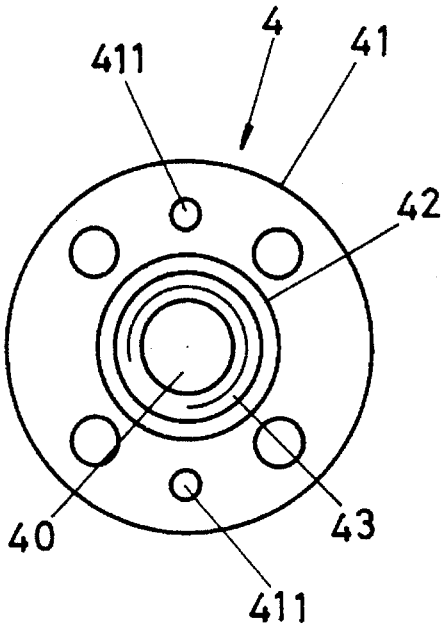
FIG. 4 is a rear view of a sleeve in the rotating device.
Figure 5:
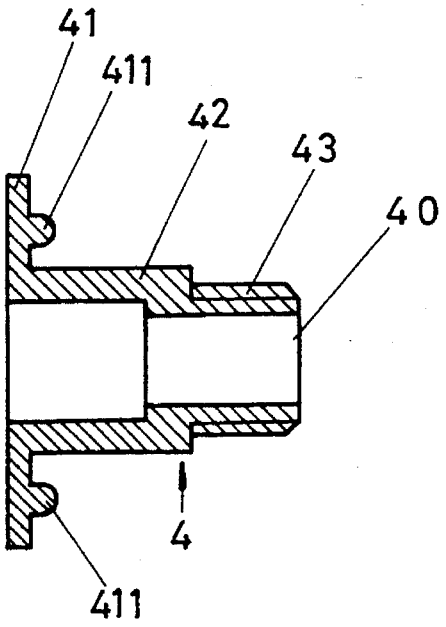
FIG. 5 is a cross-sectional view of the sleeve in the rotating device.

The first sleeve 4 shown in FIGS. 4 and 5 has a tubular portion 42 and a flange 41 extending from the rear end of the tubular portion 42. The tubular portion 42 has a front male thread 43. The flange 41 has opposite projections 411 on a front side to engage the holes 17 of the base 1 so that the first sleeve is secured to the base 1. The tubular portion 42 of the first sleeve 4 fits in a shaft hole 50 of the rotatable sleeve 5.

Figure 7:
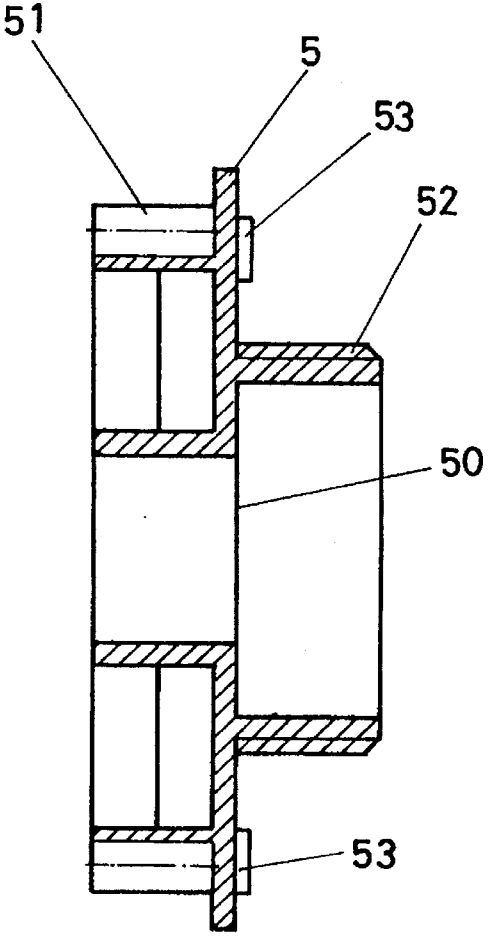
FIG. 7 is a cross-sectional view of the rotatable sleeve in the rotating device for a protective net of an electric fan of the present invention.
Figure 6:
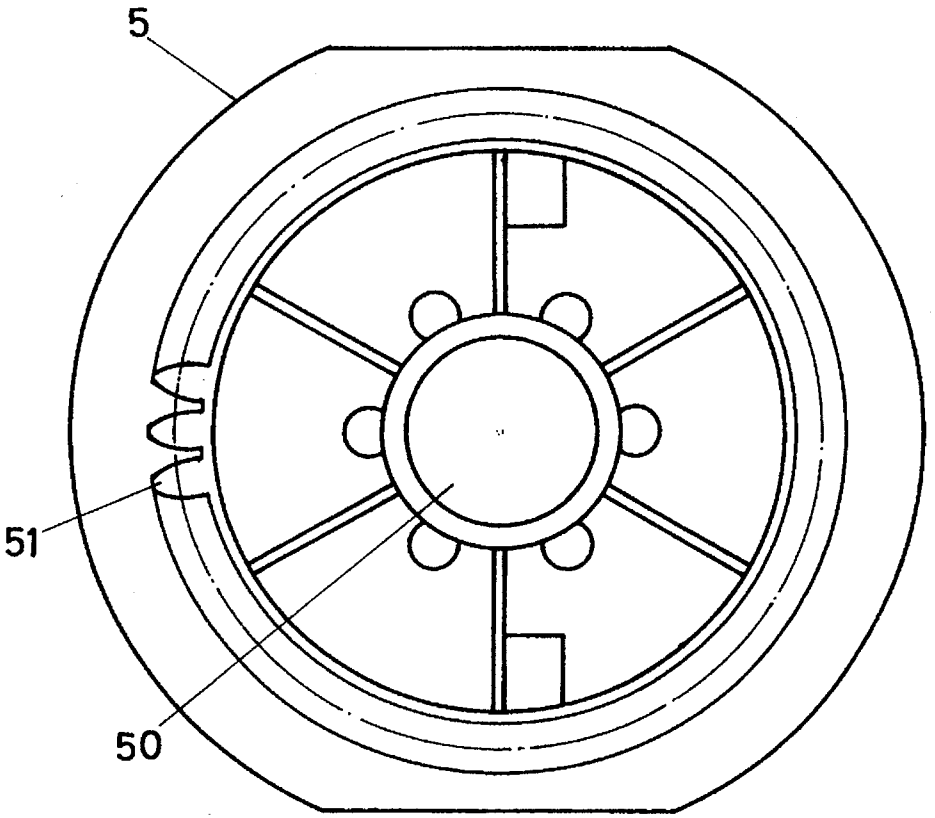
FIG. 6 is a rear view of a rotatable sleeve in the rotating device.

The rotatable sleeve 5, shown in FIGS. 6 and 7, is shaped like a hollow disc, and has a rear gear portion 51 to engage the gear 3 so that the rotatable sleeve 5 may be rotated by the gear 3. A flange 54 is provided between the gear portion 51 and a front tubular male-threaded portion 52. The shaft hole 50 has a rear small diameter portion and a front large diameter portion. The front large portion receives the rotatable sleeve locking nut 6 therein, and the rear small diameter portion receives the tubular portion 42 of the first sleeve 4 therein, so that the rotatable sleeve 5 may rotate with the first sleeve 4 as a pivot. The flange 54 has three projections 53 spaced a front surface to engage three holes 103 in a net ring 102 of a protective net 101.

Figure 9:
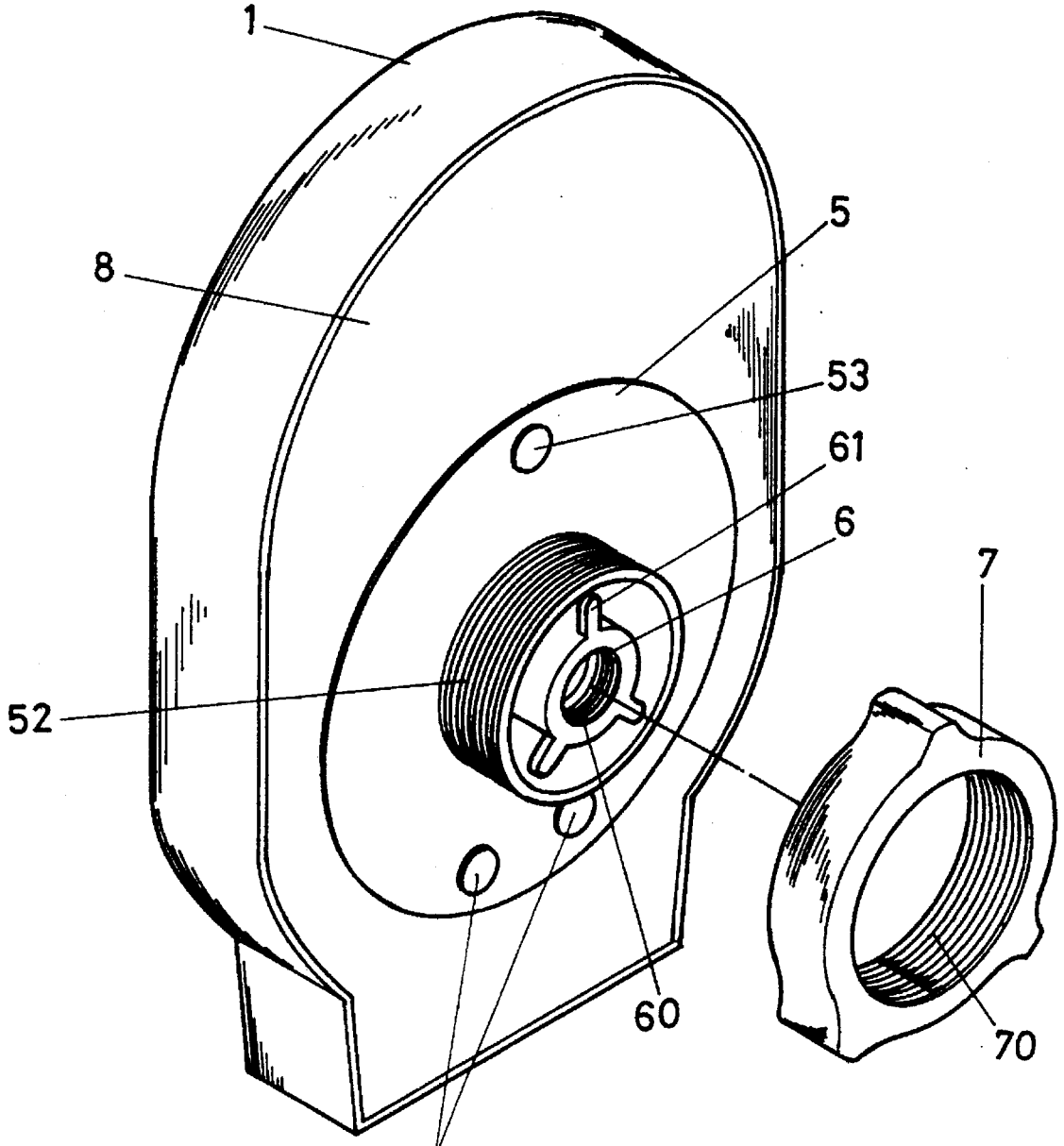
FIG. 9 is a perspective view of a net ring, a net locking nut and a rotatable sleeve locking nut in the rotating device for a protective net of an electric fan of the present invention.

The rotatable sleeve locking nut 6 shown in FIGS. 1 and 9 is cylindrical, and fits in the front large diameter portion of the shaft hole 50 of the rotatable sleeve 5. The locking nut 6 has a center female-threaded hole 60 to engage the thread 43 of the first sleeve 4 to secure the rotatable sleeve 5 between the first sleeve 4 and the rotatable sleeve locking nut 6. The rotatable sleeve locking nut 6 also has three projections 61 spaced equally apart and extending from an outer edge of its front end for manually rotating the nut 6 to screw onto the first sleeve 4.

The net locking nut 7 shown in FIGS. 1 and 9 has a female threaded hole 70 to engage the male-threaded portion 52 of the rotatable sleeve 5 to secure the net ring 102 of the protective net 101 on the rotatable sleeve 5 so that the net 101 may be rotated synchronously with the rotatable sleeve 5.

Figure 8:
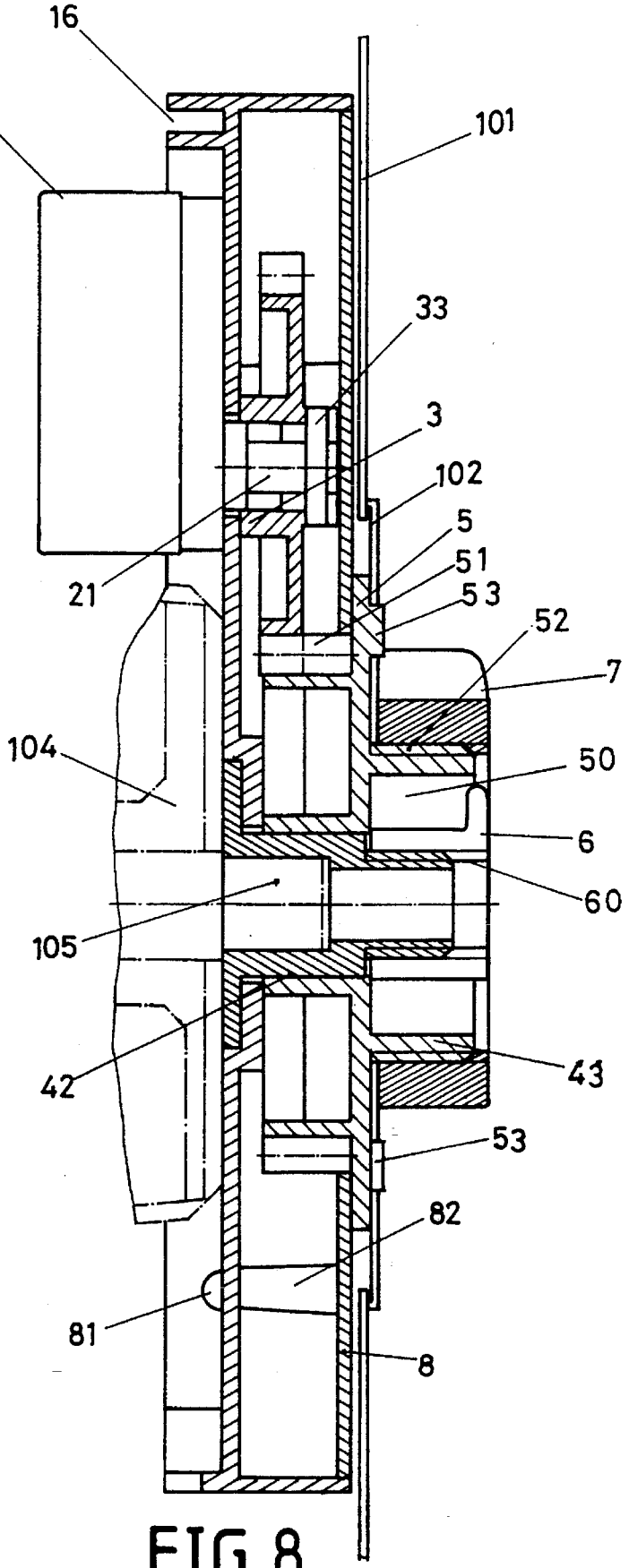
FIG. 8 is a cross-sectional view of the rotating device for a protective net of an electric fan of the present invention.

The front cap 8 shown in FIGS. 1, 8 and 9, is a plate, and is nearly round with a straight lower edge. The cap 8 has four lateral posts 82 each bored with an end screw hole to face the ends of the four holes 15 of the base 1. Four screws 81 are screwed into the posts 82 to secure the front cap 8 on the front open side of the base 1. The cap 8 also has a hole 80 a little larger than the diameter of the rotatable sleeve 5 for the rotatable sleeve 5 to fit into when the cap 8 covers the front side of the base 1, so that the rotatable sleeve 5 does not touch the cap 8.

The housing 9 houses not only the motor of an electric fan, but also the motor 2 and the first sleeve 4 of the rotating device. The housing 9 has a front end circumferential wall edge that fits into the groove of the base 1.

Figure 10:
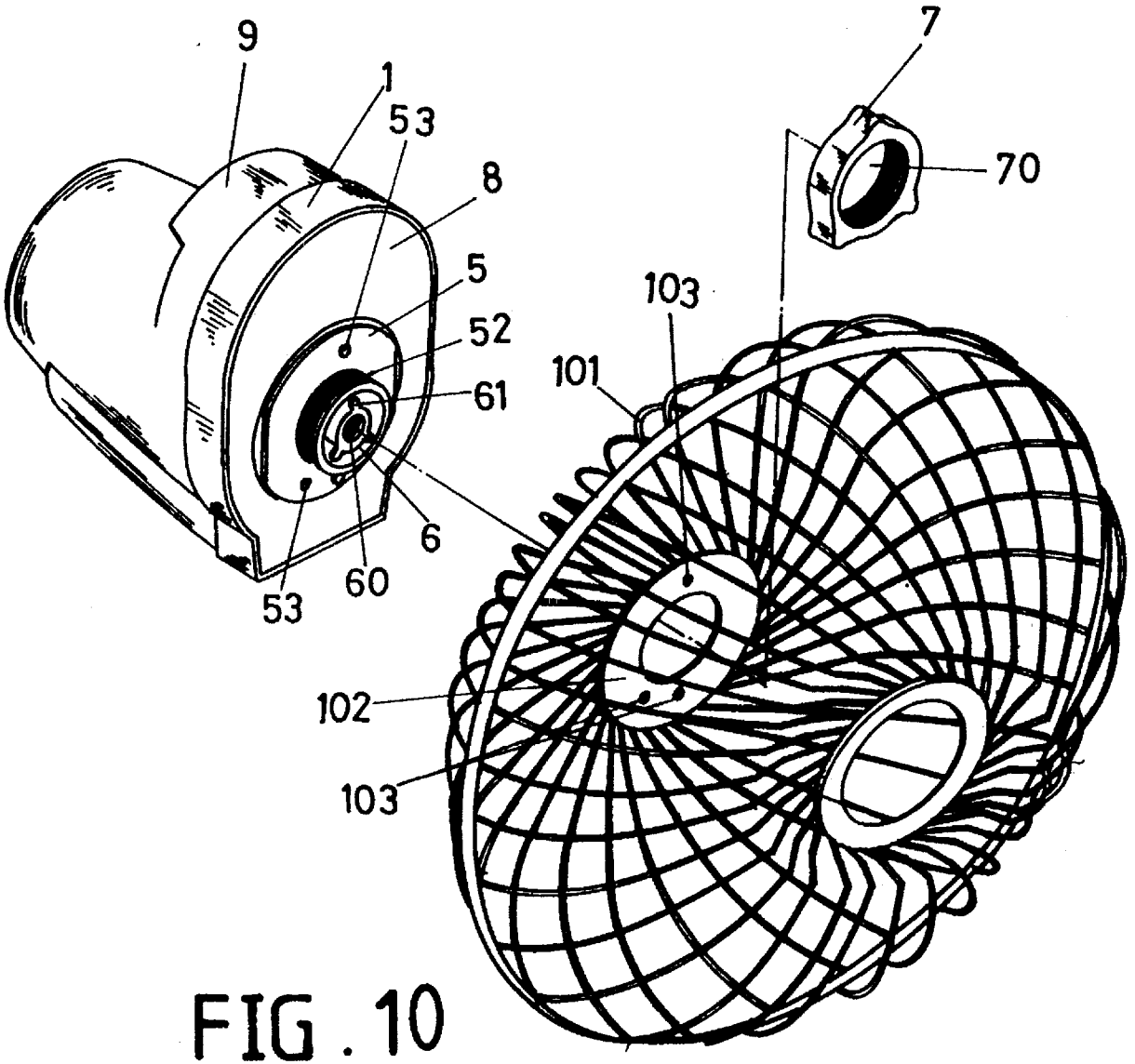
FIG. 10 is an exploded perspective view of relative condition of the net locking nut and the rotatable sleeve locking nut and the protective net of an electric fan of the present invention.
Figure 11:
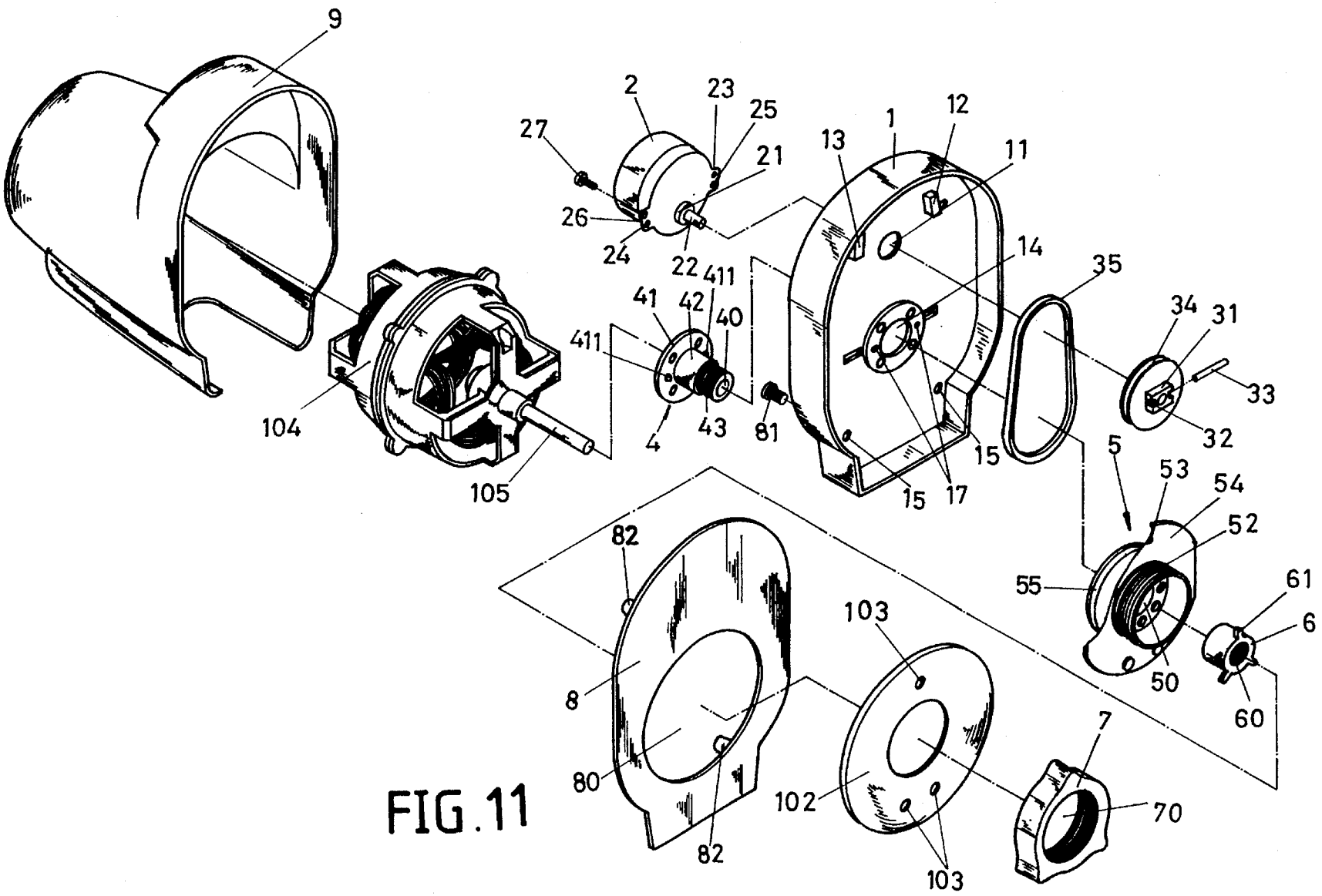
FIG. 11 is an exploded perspective view of a second embodiment of the rotating device for a protective net of an electric fan of the present invention.

In assembling, as shown in FIGS. 8, 9 and 10, the shaft 21 of the motor 2 is made to fit through the shaft hole 11 of the base 1 from the rear side. The shaft 21 engages the gear 3, with the pin 33 fitting in the pin hole 22 of the shaft 21 and also the pin hole 32 of the gear 3. The screws 27 secure the motor 2 with the base 1 by screwing into the projections 12, 13. The first sleeve 4 is put through and secured in the center hole 14 of the base 1, with the tubular portion 42 fitting in the small portion of the shaft hole 50 of the rotatable sleeve 5. Next, the rotatable sleeve locking nut 6 is screwed onto the male threaded portion 43 of the first sleeve 4, being received in the large portion of the shaft hole 50 of the rotatable sleeve 5, and securing the rotatable sleeve 5 between the first sleeve 4 and the nut 6. Meanwhile, the gear portion 51 is engaged with the gear 3, and the male threaded portion 52 projects through a hole of the net ring 102 of the protective net 101, with the three projections 53 engaging the holes 103. Then the net locking nut 7 is fixed with the rotatable sleeve 5 by screwing the threaded portion 52 into the threaded hole 70.

The shaft 105 of the motor 104 of an electric fan passes through the shaft hole 40 of the first sleeve 4, the threaded hole 60 of the rotatable sleeve locking nut 6 and the threaded hole 70 of the net locking nut 70 to be attached to a fan blade (not shown in the drawings). Therefore, the blade of the electric fan and the protective net are independently rotated so that the protective net may give rise to illusory images to the human eye, and forcing the wind produced by the propeller to swirl around in all directions.

A second embodiment of the present invention comprises the same components as the first embodiment, except the gear teeth 51 are replaced by a pulley 55, the main gear 3 is replaced by a main pulley 34, and the pulley 55 and the main pulley 34 are rotated by belt 35.

What is claimed is:

1. A rotating device for a protective net of an electric fan comprising:

a vertical base with an open front side, having a shaft hole in an upper portion of a rear wall to receive a shaft of a synchronous motor, said base further including two projections on an inner surface of the rear wall above the shaft hole, said base further including two screw holes, a center hole to receive a tubular portion of a first sleeve, two sets of holes on opposing sides of the center hole to receive projections of the first sleeve therein, and two pairs of post holes respectively in an upper and a lower portion of the rear wall to receive four posts of a front cap, said posts receiving screws to secure the front cap to the vertical base, said base further including a circumferential groove in a rear circumferential edge to receive a front end circumferential wall edge of a housing;

a synchronous motor secured at a rear side of the base, said motor having a shaft passing forward through the shaft hole in the base and affixed to a gear by means of a pin fitting in a lateral pin hole in the shaft and a lateral pin hole of a center projection of the gear so that the gear rotates with the shaft, said gear engaging a gear portion of a rotatable sleeve;

said first sleeve having a tubular portion and a flange extending laterally from a rear end of the tubular portion, the tubular portion having a front male threaded section, the tubular portion fitting through the center hole of the base to fit in a shaft hole of a rotatable sleeve, the front male-threaded section engaging a female threaded hole of a rotatable sleeve locking nut;

the rotatable sleeve having a rear gear portion, an intermediate flange and a front male threaded tubular portion, a center shaft hole having a front large diameter portion and a rear small diameter portion, and three projections on a front surface of the intermediate flange for engaging three holes in a net ring, the front large portion of the shaft hole receiving a rotatable sleeve locking nut therein, the small diameter portion fitting around the smooth section of the tubular portion of the first sleeve so that the rotatable sleeve rotates with the first sleeve;

said rotatable sleeve locking nut having a center female threaded hole to engage the male threaded section of the tubular portion of the first sleeve to secure the protective net of the electric fan to the sleeve;

a net locking nut having a female threaded hole engaging the male threaded section of the rotatable sleeve to secure a net ring to the rotatable sleeve;

a front cap having a shaft hole a little larger than the diameter of the rotatable sleeve;

a housing protecting both a motor of an electric fan and the synchronous motor, the housing having a front circumferential wall edge to fit into the circumferential groove of the base; and said synchronous motor rotating said gear, said rotatable sleeve and then in turn the protective net of the electric fan, the protective net rotating to swirl wind produced by the fan in all directions, giving rise to illusory effects to the human eye by its rotation.

2. The rotating device for a protective net of an electric fan as claimed in claim 1 wherein:

said shaft hole of said first sleeve, the threaded hole of said rotatable sleeve locking nut and the threaded hole of said net locking nut are for the shaft of the motor of an electric fan to pass through, enabling the shaft of the electric motor and the protective net to rotate independently.

3. A rotating device for a protective net of an electric fan comprising:

a vertical base with an open front side, having a shaft hole in an upper portion of a rear wall to receive a shaft of a synchronous motor, said base further including two projections on an inner surface of the rear wall above the shaft hole, said base further including two screw holes, a center hole to receive a tubular portion of a first sleeve, two sets of holes on opposing sides of the center hole to receive projections of the first sleeve therein, and two pairs of post holes respectively in an upper and a lower portion of the rear wall to receive four posts of a front cap, said posts receiving screws to secure the front cap to the vertical base, said base further including a circumferential groove in a rear circumferential edge to receive a front end circumferential wall edge of a housing;

a synchronous motor secured at a rear side of the base, said motor having a shaft passing forward through the shaft hole in the base and affixed to a main pulley by means of a pin fitting in a lateral pin hole in the shaft and a lateral pin hole of a center projection of the main pulley so that the main pulley rotates with the shaft, said main pulley driving a pulley affixed to a rotatable sleeve;

said first sleeve having a tubular portion and a flange extending laterally from a rear end of the tubular portion, the tubular portion having a front male threaded section, the tubular portion fitting through the center hole of the base to fit in a shaft hole of a rotatable sleeve, the front male-threaded section engaging a female threaded hole of a rotatable sleeve locking nut;

a rotatable sleeve having a rear gear portion, an intermediate flange and a front male threaded tubular portion, a center shaft hole having a front large diameter portion and a rear small diameter portion, and three projections on a front surface of the intermediate flange for engaging three holes in a net ring, the front large portion of the shaft hole receiving a rotatable sleeve locking nut therein, the small diameter portion fitting around the smooth section of the tubular portion of the first sleeve so that the rotatable sleeve rotates with the first sleeve;

said rotatable sleeve locking nut having a center female threaded hole to engage the male threaded section of the tubular portion of the first sleeve;

a net locking nut having a female threaded hole engaging the male threaded section of the rotatable sleeve to secure a net ring to the rotatable sleeve;

a front cap having a shaft hole a little larger than the diameter of the rotatable sleeve;

a housing protecting both a motor of an electric fan and the synchronous motor, the housing having a front circumferential wall edge to fit into the circumferential groove of the base; and said synchronous motor rotating said main pulley, said rotatable sleeve and then in turn the protective net of the electric fan, the protective net rotating to swirl wind produced by the fan in all directions, giving rise to illusory effects to the human eye by its rotation.

4. The rotating device for a protective net of an electric fan as claimed in claim 3 wherein:

said shaft hole of said first sleeve, the threaded hole of said rotatable sleeve locking nut and the threaded hole of said net locking nut are for the shaft of the motor of an electric fan to pass through, enabling the shaft of the electric motor and the protective net to rotate independently.

* * * * *